United States Patent [19]

Kubota

[11] Patent Number: 5,066,013

[45] Date of Patent: Nov. 19, 1991

[54] KUBOTAI RESTRAINT DEVICE HAVING TWO BATONS BOUND TOGETHER BY A CORD AT POINTS SPACED FROM THE ENDS OF THE BATONS

[76] Inventor: Takayuki Kubota, 1436 Ardmore Ave., Glendale, Calif. 91202

[21] Appl. No.: 536,969

[22] Filed: Jun. 12, 1990

[51] Int. Cl.[5] ..... F41B 15/02

[52] U.S. Cl. ..... 273/84 R

[58] Field of Search ..... 273/67 R, 84 R; D21/211; D22/117; 224/914

[56] References Cited

U.S. PATENT DOCUMENTS

| | | | |
|---|---|---|---|
| 3,106,398 | 10/1963 | Gowdey | 273/84 R |
| 3,454,274 | 7/1969 | Kaneshiro | D22/117 |
| 3,526,909 | 9/1970 | Kotler | 273/84 R |
| 3,934,877 | 1/1976 | White | 273/84 R |
| 4,070,023 | 1/1978 | Cutler | 273/84 R |
| 4,426,079 | 1/1984 | Mason | 273/84 R |
| 4,462,593 | 7/1984 | Carty | 273/84 R |
| 4,681,317 | 7/1987 | Brandell | 273/84 R |

OTHER PUBLICATIONS

"Black Belt", Aug. 1974, p. 7.

"Kubotan Keychain", (England: Dragon Books), 1984.

*Primary Examiner*—Edward M. Coven

*Assistant Examiner*—William M. Pierce

*Attorney, Agent, or Firm*—A. M. Fernandez

[57] ABSTRACT

A device for restraining a person by the wrist or other part on a limb comprised of two batons bound together by a woven nylon cord at a point from a flanged end of each baton that is equal to about half the length of the cord between batons. That length of cord between batons is approximately equal to the circumference of the wrist of a male adult of average height and weight. The cord is preferably a continuous cord that runs from a knot in a countersunk hole in the handle of one baton to a knot in a countersunk hole in the handle of the other baton to provide the elasticity between the batons of the total length of cord. The flanged end of each baton is tapered to provide a section that has a conical frustum shape capped by the flange.

5 Claims, 4 Drawing Sheets

KUBOTAI RESTRAINT DEVICE HAVING TWO BATONS BOUND TOGETHER BY A CORD AT POINTS SPACED FROM THE ENDS OF THE BATONS

BACKGROUND OF THE INVENTION

The invention relates to a restraint device comprised of two rods referred to hereafter as batons connected together by a nylon cord. After wrapping the cord and batons around a limb (wrist, arm or ankle) of a person to be restrained and controlled, pressing the two batons toward each other produces disabling pain should the person resist.

An ancient martial arts weapon known by the name "nunchaku" consists of two batons bound together by a short nylon cord (about 2.5 inches long) protruding from the end of each baton. The nunchaku is often used by "kung fu" fighters as a flailing-baton weapon, but the flailing baton on the end of the cord may miss the target only to swing completely around and strike the user of the device. Consequently, the nunchaku is not recommended for use as an aggressive or even defensive weapon except while holding both batons in one hand for use as though one club.

Although used primarily by kung fu fighters and made popular in motion pictures during the '70s, police departments in many states reportedly now use the nunchaku, not as a "flail" (a device consisting of a handle with a free swinging stick attached to its end) but as a restraint device. Holding a baton in one hand and using the other baton in the other hand, the cord attached between the batons is wrapped over the wrist, arm, or even an ankle of the person to be restrained. By pressing the two batons toward each other, disabling pain is produced, but if too much force is applied to the batons they may crush the wrist, arm or ankle like a nutcracker crushes the shell of a walnut.

The police departments believe the nunchaku provides an alternative weapon to a gun or nightstick for restraining a person who may be violent or at least may struggle violently, although it is difficult to apply on a person other than a passive demonstrator. If the person being restrained resists, the nunchaku batons are pressed toward each other with greater force to produce greater pain. But while the nunchaku may be an effective restraint device, there is a risk of causing physical injury, including crushed bones. It is therefore not a device recommended for use against nonviolent persons who simply resist restraint and control, such as demonstrators or protestors who resist being removed from a scene under court order. Such incidents have occurred recently in breaking up antiabortion demonstrations where the demonstrators have sought to illegally block access to abortion clinics. An object of this invention is to provide law enforcement personnel with a restraint device which may be used effectively without a great risk of injury to the person being restrained.

SUMMARY OF THE INVENTION

These and other problems of the prior-art nunchaku are overcome by the present invention to be known under the trade name and trademark Kubotai. It is comprised of two batons bound together by a cord of a length approximately equal to the circumference of the average male wrist at points spaced about one half of the cord length from the ends of the batons opposite their handles. The end of each baton opposite its handle is shaped to have a monolithic section that is a frustum of a cone with a flange on the end. The flange preferably has the same cross section as the handle.

To apply the Kubotai restraint device, one end of the cord is placed against the limb of a person to be restrained using one baton, the other end of the cord is brought around the limb, and looped over the flanged end of the one baton. This can be done in one quick motion as the cord is brought up or down against the limb.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
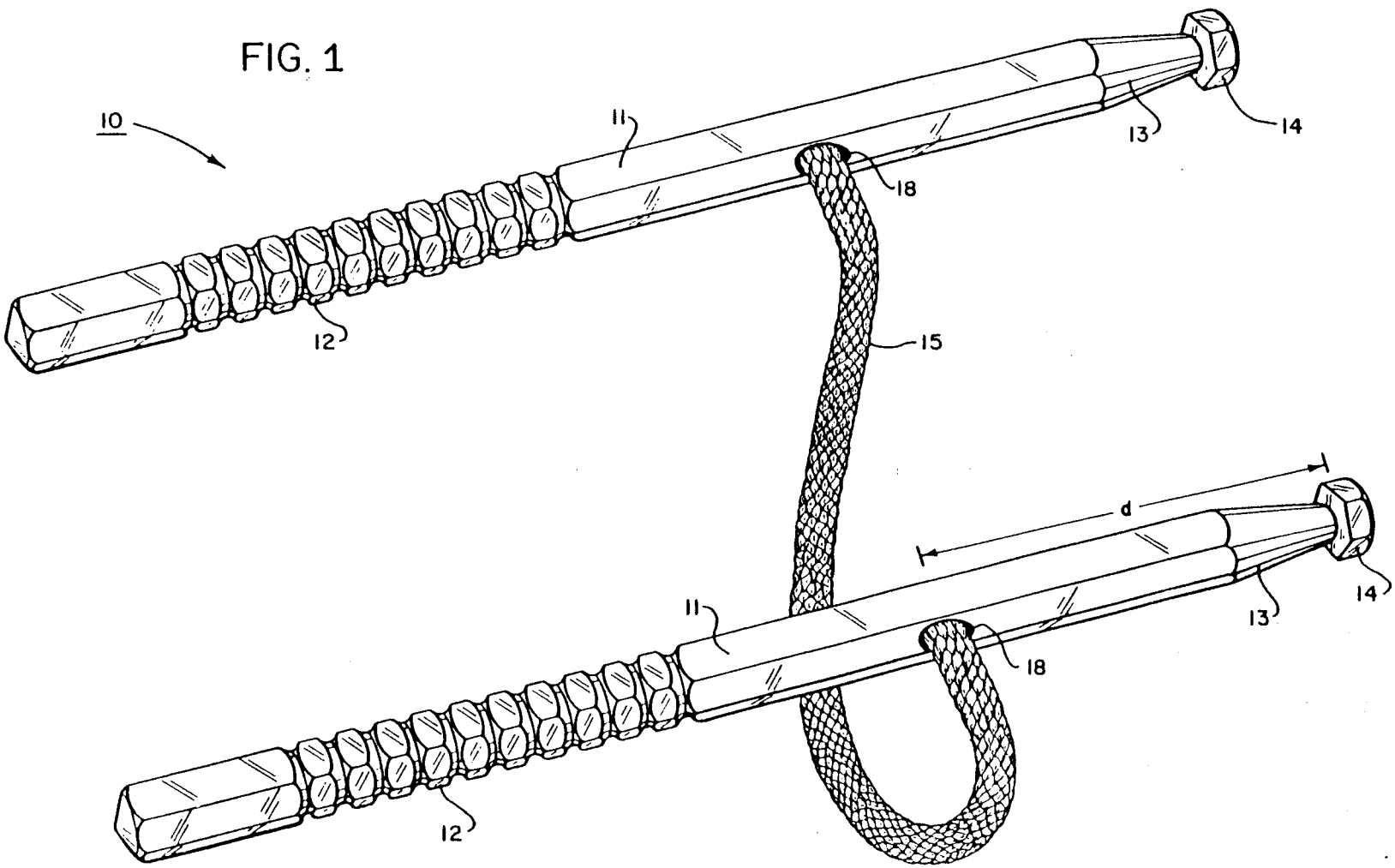
FIG. 1 is an isometric view of the present invention comprised of two batons bound together by a nylon cord secured to each baton at a point spaced a distance from the end opposite the handle of the baton.

Referring to FIG. 1, the Kubotai device 10 of the present invention is comprised of two batons 11, each having a knurled handle 12 at one end and a shape 13 that is a frustum of a cone at the other end with a monolithic flange 14 capping the frustum shape 13. The batons are bound together by a woven nylon cord 15 at some distance d from the flange 14 equal to about half the length of the cord, where the cord length is preferably equal to about the circumference of the average wrist of an adult male of medium height and weight.

Figure 2:
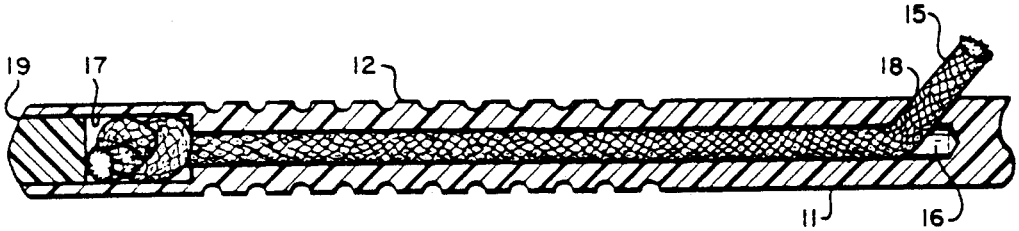
FIG. 2 is a cross section of a portion of one baton taken along a line 2—2 in FIG. 3 to show how the cord is secured thereto.

In attaching the cord 15 to the batons, an axial hole 16 is drilled through about two-thirds the length of the handle 12 and countersunk with a larger diameter hole 17, as shown in FIG. 2. An angled hole 18 is then drilled through the side of the baton to intercept he axial hole 16. One end of the cord 15 is inserted through the angled hole 18 and pushed through the axial hole 16 until it protrudes through the countersunk hole 17 at the base of the handle 12. A knot is then tied in the end of the cord, and the cord is pulled back and taut in the baton. A plug 19 is inserted in the countersunk hole 17 to seal the knot.

Figure 3:
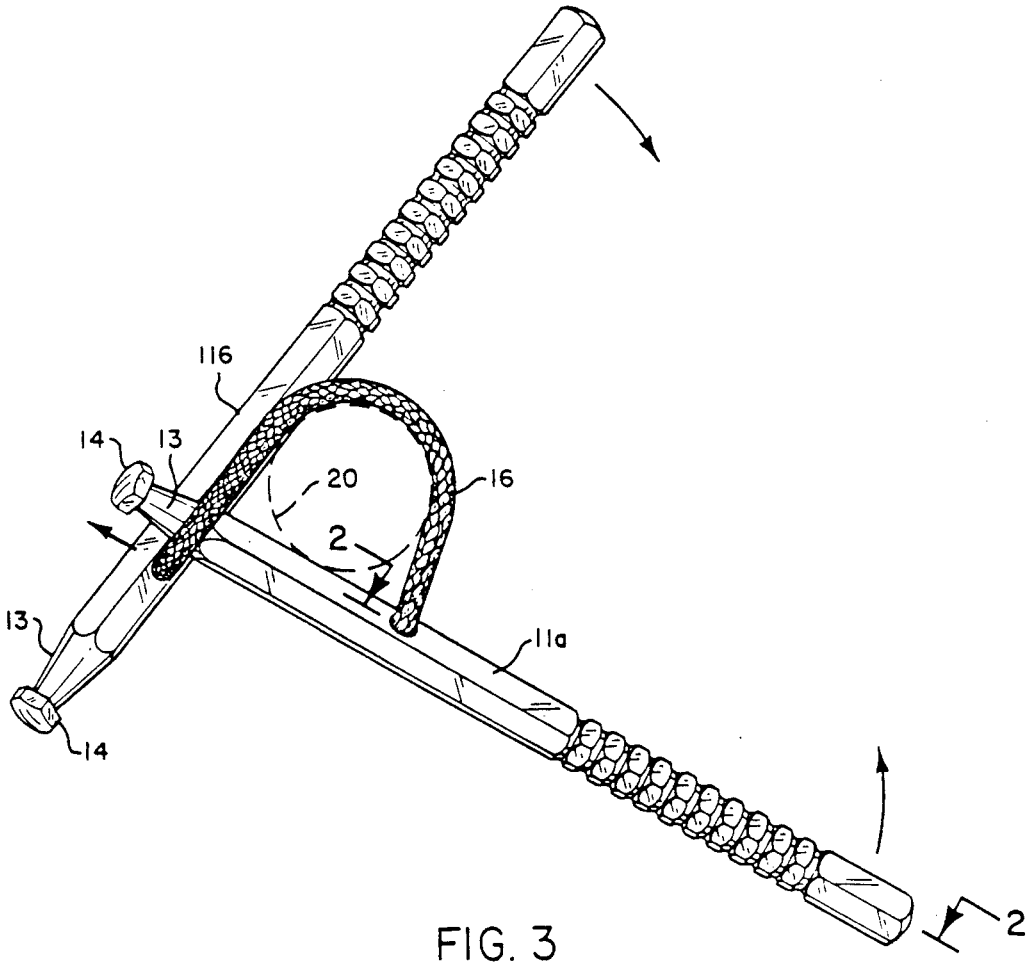
FIG. 3 illustrates the cord between two batons wrapped around a cylinder shown in a dotted line to represent a limb of a person to be restrained and brought under control by pressing the handles toward each other, at which time the loop of the cord around the flanged end of one baton may slip to where a flange stops the loop from slipping off the baton.

In applying the Kubotai restraint device to a limb of a person, which will most often be the wrist, the cord 16 is placed against the limb using one baton 11*a* as shown in FIG. 3 where the limb is represented for illustration by a dotted line circle 20. Using the other baton 11*b*, the cord is wrapped around the limb counterclockwise as viewed in FIG. 3 and then, still using the baton 11*b*, the cord is looped over the flanged end of the baton 11*a*. Upon moving the handles 12 of the two batons toward each other, the cord around the person's limb tightens and slips to the end of the frustum shape 13 against the flange 14. At least one of the batons will then be in contact with the limb to apply pressure directly upon the limb. That pressure of the baton produces disabling pain but without great risk of injury to the person.

By making the batons out of stock material that is hexagonal, for example, one or two corners will bear against the person's limb and produce greater localized disabling pain with less pressure from the batons. What makes this restraint device so much safer to use is the added length of the nylon cord between batons, which is about 12 inches in the Kubotai device plus the total length within each baton from the knot tied in the countersunk hole 17 to the exit hole 18 versus about 4 inches between batons in the nunchaku device plus whatever length is in the batons. The greater the total length of the cord, the greater the total stretch of the nylon cord for a given force since its total elastic stretch is a function of total length. Consequently, by providing a greater length of cord between batons, a greater amount of stretch is provided for a given force imposed by the user through the batons. That coupled with providing a shorter baton leverage due to the batons being bound together at a point some distance from the flanged ends of the batons, greatly reduces the actual pressure of the batons on the person's limb in response to a given force applied to the batons while still producing the desired disabling pain.

Figure 4A:
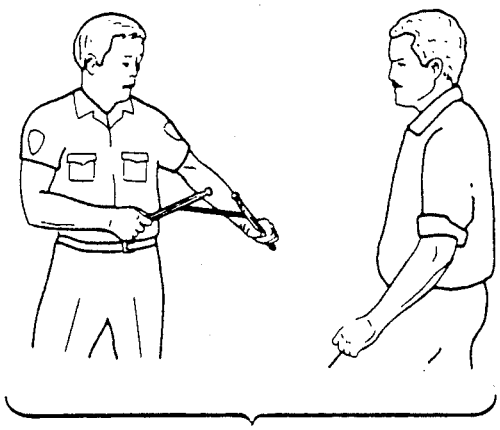
FIGS. 4*a* through 4*f* illustrate a policeman being approached by an aggressor and then being restrained by the policeman using the Kubotai device of the present invention by coming up to the outstretched arm of the aggressor, bringing the cord up around the arm and looping it around the flanged end of the one baton, then pressing the baton handles toward each other to produce disabling pain while walking the restrained arm around the person's back.
Figure 4B:
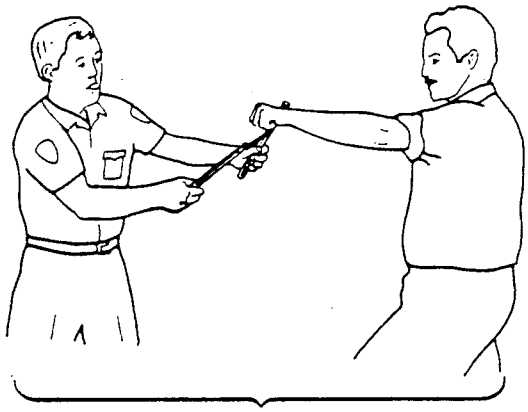
Figure 4C:
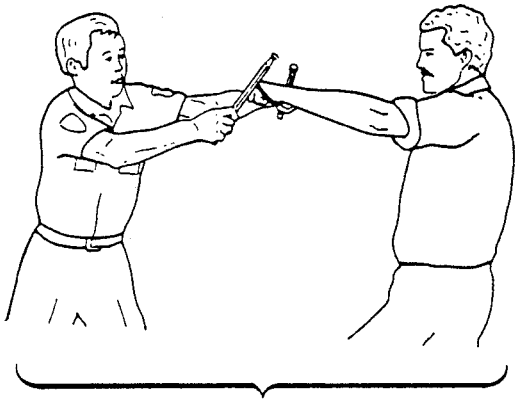
Figure 4D:
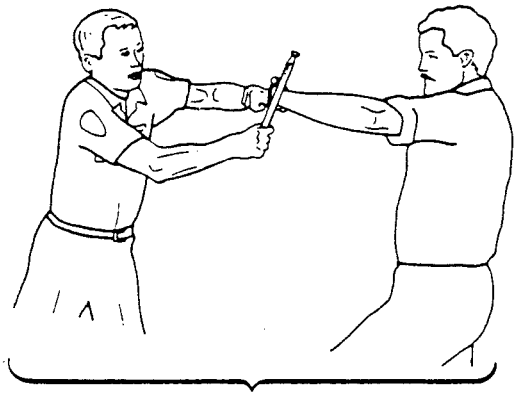
Figure 4E:
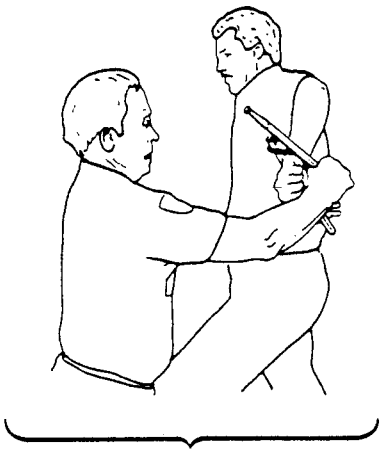
Figure 4F:
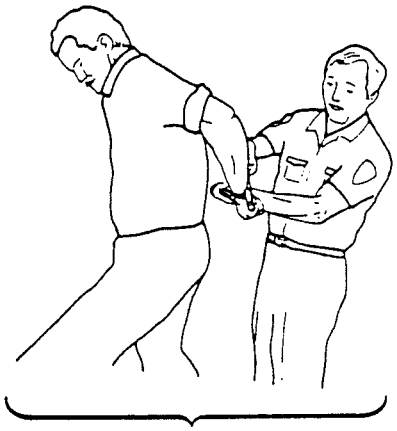
Figure 5A:
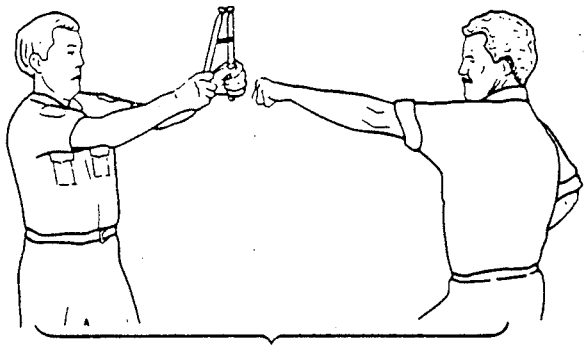
FIGS. 5*a* through 5*d* illustrate a policeman restraining an aggressor by coming down on his outstretched arm with the cord between the batons.
Figure 5B:
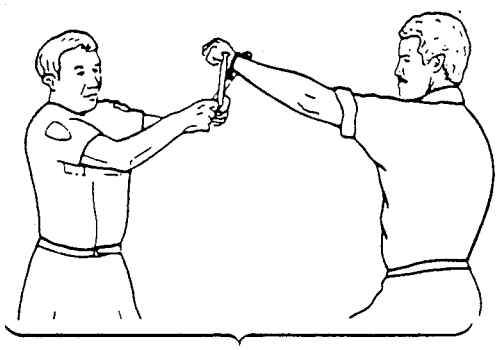
Figure 5C:
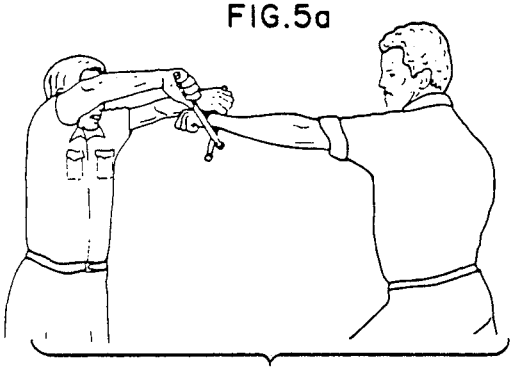
Figure 5D:
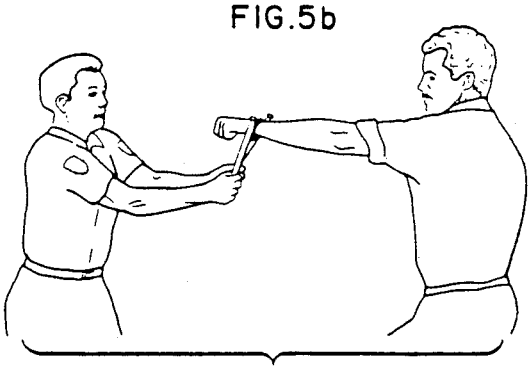

Another advantage of the Kubotai restraint device is the ease with which it may be applied. By advancing the cord to the person's limb using one baton in the left hand (assuming a right-handed police officer), the right hand can quickly move the other baton around the limb and over the end of the left hand baton using a circular motion to throw a loop of the cord over the flanged end of the left hand baton. FIGS. 4*a* through 4*d* illustrate this technique in a situation where the police officer finds it best to come up to the person's wrist from below until contact is made near the left hand baton (FIG. 4*b*), then using the right hand baton wrapping the cord up (FIG. 4*c*) and around the end of the left hand baton. Once the wrist is restrained in this fashion, the police officer may readily walk the restrained wrist around to the back as shown in FIGS. 4*e* and 4*f*. Applying some tension on the cord with the batons while this is done produces such pain that the person being restrained is disabled.

Figure 6A:
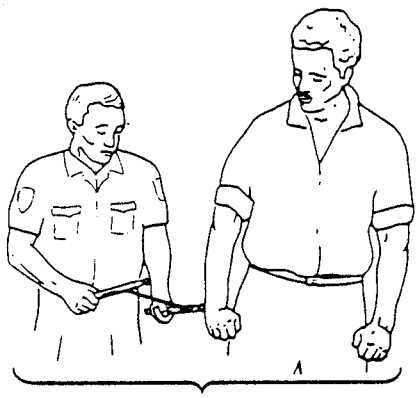
FIGS. 6*a* through 6*d* illustrate a policeman restraining an aggressor by engaging his arm from behind with the cord between two batons.
Figure 6B:
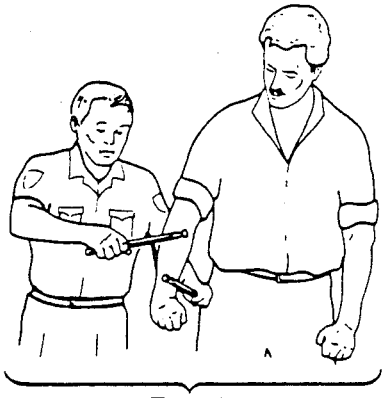
Figure 6C:
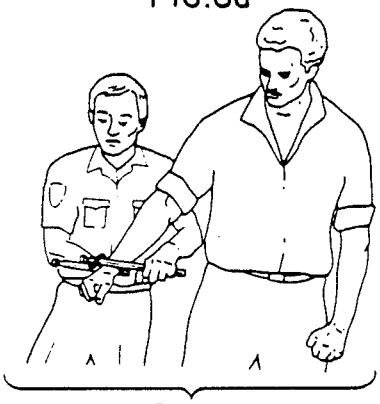
Figure 6D:
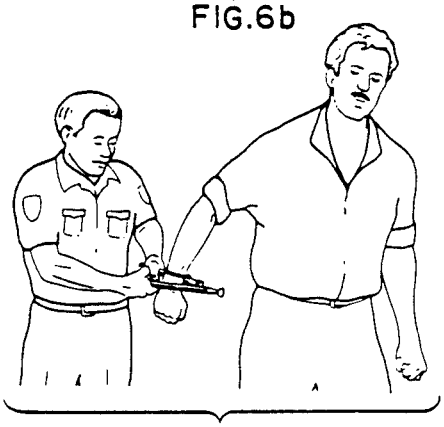

FIGS. 5*a* through 5*d* illustrate how the Kubotai device is applied to the wrist of a person by coming down on it with the cord (FIGS. 5*a* and 5*b*) then after throwing a loop over the flanged end of one baton with the end of the other (FIG. 5*c*), applying some tension to the cord by a force applied to the baton handles toward each other. FIGS. 6*a* through 6*b* show the police officer approaching the person's wrist from behind and then throwing a loop over the flanged end of one baton (FIG. 6*c*).

The cord securing the two batons together is preferably equal to the circumference of the wrist of an average adult male (about 7½ inches) and the distance d of the cord from the flanged end is preferably half the length of the nylon cord. The batons of the preferred embodiment are 12 inches long and 9/16 inches thick from one flat face of the hexagonal cross section to an opposite flat face. These dimensions may be increased or decreased, but there is not much room for decrease since the average wrist for a male adult is about 7 inches in circumference. There is some room for increasing dimensions, but if the cord is made too long, applying sufficient tension to the cord may require crossing the batons, which is not convenient to do without crossing one's hands, and if the batons are made too long, they may become unwieldy. Moreover, increasing the length of the batons increases the leverage of the user resulting in the possibility of too much tension in the cord resulting in physical injury to the person being restrained, as in the case of the nunchaku device which uses the full length of the batons (12 inches or more) as leverage handles. In contrast, the present invention effectively cuts the leverage handle of 12 inch batons to about 8 inches by securing the two batons together with a cord at points almost 4 inches from the flanged ends, yet providing an effective restraining device that is easy to apply and still produces disabling pain without the risk of crushing bones or causing injuring the skin and muscle of the person being restrained. Consequently, the dimensions given above are considered near optimum, but the exact dimensions given should not be taken as a limitation to the scope of coverage of the following claims. Even the thickness of the batons is merely optimum for fabrication out of extruded plastic stock, such as cellulose acetate, notable for toughness, high impact strength and ease of fabrication.

What is claimed is:

1. A device for restraining a person by applying it to the wrist or other part on a limb comprising a woven nylon cord and two batons, each baton having a handle at one end, said batons being connected by said woven nylon cord protruding from each baton at a point four inches from the end opposite said handle thereof, leaving only a majority of said baton length from the end of said handle to said cord for leverage in applying tension to said cord, said cord being of a length between batons approximately equal to the circumference of the wrist of an average male adult, and the end of each baton opposite the handle thereof being shaped to have a monolithic flange section that is frustum of a cone with a base thereof contiguous with said handle.

2. A device as defined in claim 1 wherein each baton has an axial hole a predetermined depth from an end of said handle opposite said section that is a frustum of a cone to said point four inches from said end of said baton opposite said handle, a countersunk hole a small fraction of said depth of said axial hole, and a transverse hole at said point intercepting said axial hole, and wherein each end of said cord is inserted through said intercepting hole of a separate baton through said axial hole and into said countersunk hole, and further comprising a knot tied in each end of said cord, said knot being positioned in said countersunk hole, thus providing a continuous cord extending from the countersunk hole of one baton to the countersunk hole of the other baton with a length between batons approximately equal to the circumference of the wrist of an average male adult.

3. A device for restraining a person by the wrist or other part on a limb comprised of two batons and a cord, each baton having a handle at one end and a flange at an opposite end, said batons being attached to each other by said cord protruding from each baton at a point a distance from said flanged end thereof, said distance being equal to about half the length of said cord between said batons, and said length of said cord between said batons being approximately equal to the circumference of the wrist of a male adult of average height and weight.

4. A device as defined in claim 3 wherein said flange end of each baton is tapered to provide a section that has a conical frustum shape capped by said flange.

5. A device for restraining a person by applying it to the wrist or other part on a limb comprising a cord, two batons, each baton having a handle at one end and a flanged end opposite said handle end, said batons being connected by said cord protruding from each baton at a point one third said baton length from said flanged end, each end of said cord being attached to a different one of said two batons.

* * * * *